US012624886B2

(12) United States Patent
Lessa

(10) Patent No.: US 12,624,886 B2
(45) Date of Patent: May 12, 2026

(54) VACUUM PORT COVER AND ALIGNER FEATURES

(71) Applicant: WHIRLPOOL CORPORATION, Benton Harbor, MI (US)

(72) Inventor: Marcel Bögger Lessa, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 245 days.

(21) Appl. No.: 18/499,640

(22) Filed: Nov. 1, 2023

(65) Prior Publication Data

US 2025/0137712 A1 May 1, 2025

(51) Int. Cl.
*F25D 23/02* (2006.01)

(52) U.S. Cl.
CPC ..... *F25D 23/028* (2013.01); *F25D 2201/00* (2013.01); *F25D 2700/00* (2013.01)

(58) Field of Classification Search
None
See application file for complete search history.

(56) References Cited

U.S. PATENT DOCUMENTS 2,000,882 A * 5/1935 Comstock ..... F25D 23/062 220/592.27
4,745,015 A * 5/1988 Cheng ..... E04B 1/803 428/920
5,027,574 A * 7/1991 Phillip ..... E06B 3/66309 52/786.13
5,318,108 A * 6/1994 Benson ..... F01N 5/02 165/96
5,345,814 A * 9/1994 Cur ..... G01M 3/202 73/49.3
5,500,305 A * 3/1996 Bridges ..... E04B 1/803 29/DIG. 44
5,934,085 A * 8/1999 Suzuki ..... F25D 23/064 220/592.27
6,109,712 A * 8/2000 Haworth ..... A47L 15/4209 312/406
10,039,390 B2 8/2018 Artwohl et al.
10,119,751 B2 11/2018 Choi
10,143,099 B2 * 11/2018 Cordes ..... H05K 5/0069
10,598,427 B2 3/2020 Choi
10,605,520 B1 * 3/2020 Ekshinge ..... F25D 23/067
10,995,488 B1 * 5/2021 Allard ..... F25D 23/062
11,021,905 B1 6/2021 Ekshinge
11,414,918 B2 8/2022 Ekshinge
(Continued)

FOREIGN PATENT DOCUMENTS

EP 4180355 A1 5/2023
EP 4198422 A1 * 6/2023 ..... G01L 19/148

OTHER PUBLICATIONS

US 10,988,968 B1, 04/2021, Ekshinge (withdrawn)

*Primary Examiner* — Hanh V Tran
(74) *Attorney, Agent, or Firm* — Price Heneveld LLP

(57) ABSTRACT

A vacuum-insulated door for a cooling appliance includes an outer skin defining a vacuum-insulated cavity. A vacuum port is in fluid communication with the vacuum-insulated cavity through the outer skin. A vacuum inlet housing is connected to the vacuum port and extends from the outer skin. A vacuum port cover assembly includes a bracket connected to the outer skin that includes a first pocket for locating the vacuum inlet housing. A cover is connected to the bracket.

19 Claims, 9 Drawing Sheets

(56) References Cited

U.S. PATENT DOCUMENTS

| | | | | |
|---|---|---|---|---|
| 11,480,385 | B2 * | 10/2022 | Dherde | F25D 23/06 |
| 12,038,340 | B2 * | 7/2024 | Allard | F25D 23/028 |
| 2020/0173716 | A1 | 6/2020 | Choi | |
| 2020/0373231 | A1 * | 11/2020 | Chew | H01L 23/5385 |
| 2021/0214993 | A1 | 7/2021 | Ekshinge | |
| 2021/0265248 | A1 * | 8/2021 | Yao | H01R 43/0207 |
| 2022/0235997 | A1 | 7/2022 | Kim et al. | |
| 2022/0325572 | A1 | 10/2022 | Ekshinge | |
| 2023/0079218 | A1 | 3/2023 | Choi | |
| 2024/0203802 | A1 * | 6/2024 | Yang | H01L 23/3736 |

* cited by examiner

VACUUM PORT COVER AND ALIGNER FEATURES

BACKGROUND OF THE DISCLOSURE

The present disclosure generally relates to a vacuum port cover assembly with aligner features for a cooling appliance.

SUMMARY OF THE DISCLOSURE

According to one aspect of the present disclosure, a vacuum-insulated door for a cooling appliance includes an outer skin defining a vacuum-insulated cavity. A vacuum port is in fluid communication with the vacuum-insulated cavity through the outer skin. A vacuum inlet housing is connected to the vacuum port and extends from the outer skin. A vacuum port cover assembly includes a bracket connected to the outer skin that includes a first pocket for locating the vacuum inlet housing. A cover is connected to the bracket.

According to another aspect of the present disclosure, a vacuum-insulated door for a cooling appliance includes an outer skin defining a vacuum-insulated cavity and at least one of a tab or a stud is coupled to the outer skin. A vacuum port is in fluid communication with the vacuum-insulated cavity through the outer skin. A vacuum inlet housing is connected to the vacuum port and extends from the outer skin. A vacuum port cover assembly includes a bracket connected to the outer skin that includes a first pocket for locating the vacuum inlet housing. The bracket further includes at least one of a slot engaged with the tab or an aperture engaged with the stud.

According to yet another aspect of the present disclosure, a vacuum-insulated door for a cooling appliance includes an outer skin defining a vacuum-insulated cavity. At least one stud is coupled to the outer skin. A vacuum port is in fluid communication with the vacuum-insulated cavity through the outer skin. A vacuum inlet housing is connected to the vacuum port and extends from the outer skin. A vacuum port cover assembly includes a bracket having at least one aperture receiving the at least one stud. The bracket further includes a first pocket for locating the vacuum inlet housing. A cover is connected to the bracket such that the bracket is encased between the cover and the outer skin.

These and other features, advantages, and objects of the present disclosure will be further understood and appreciated by those skilled in the art by reference to the following specification, claims, and appended drawings.

Figure 1:
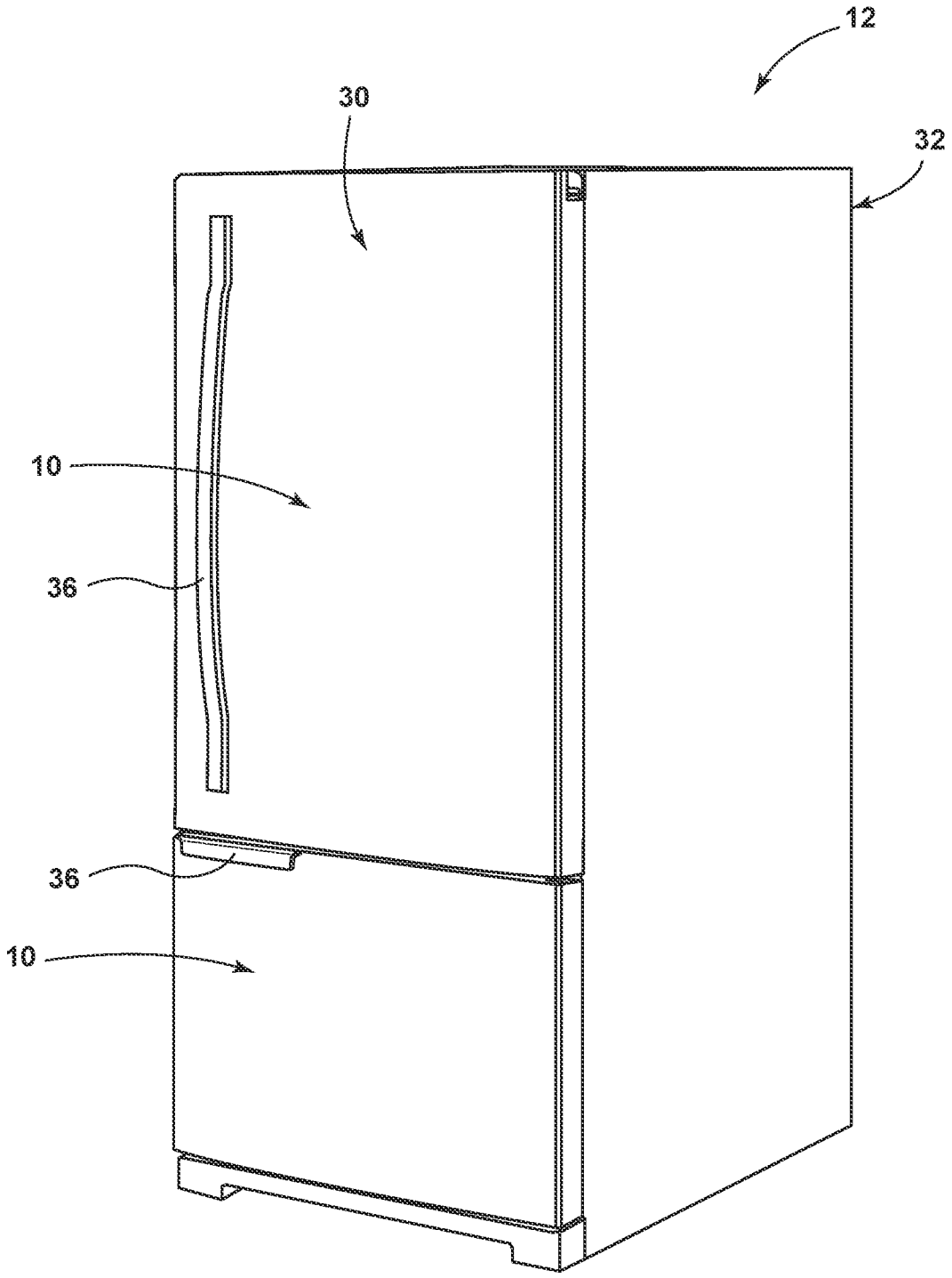
FIG. 1 is a side perspective view of a cooling appliance, according to an aspect of the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a vacuum port cover assembly with aligner features for a cooling appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-9, reference numeral 10 generally refers to a vacuum-insulated door for a cooling appliance 12. The vacuum-insulated door 10 includes an outer skin 14 defining a vacuum-insulated cavity 16. A vacuum port 18 is in fluid communication with the vacuum-insulated cavity 16 through the outer skin 14. A vacuum inlet housing 20 is connected to the vacuum port 18 and extends from the outer skin 14. A vacuum port cover assembly 22 includes a bracket 24 connected to the outer skin 14 that includes a first pocket 26 for locating the vacuum inlet housing 20. A cover 28 is connected to the bracket 24.

Figure 2:
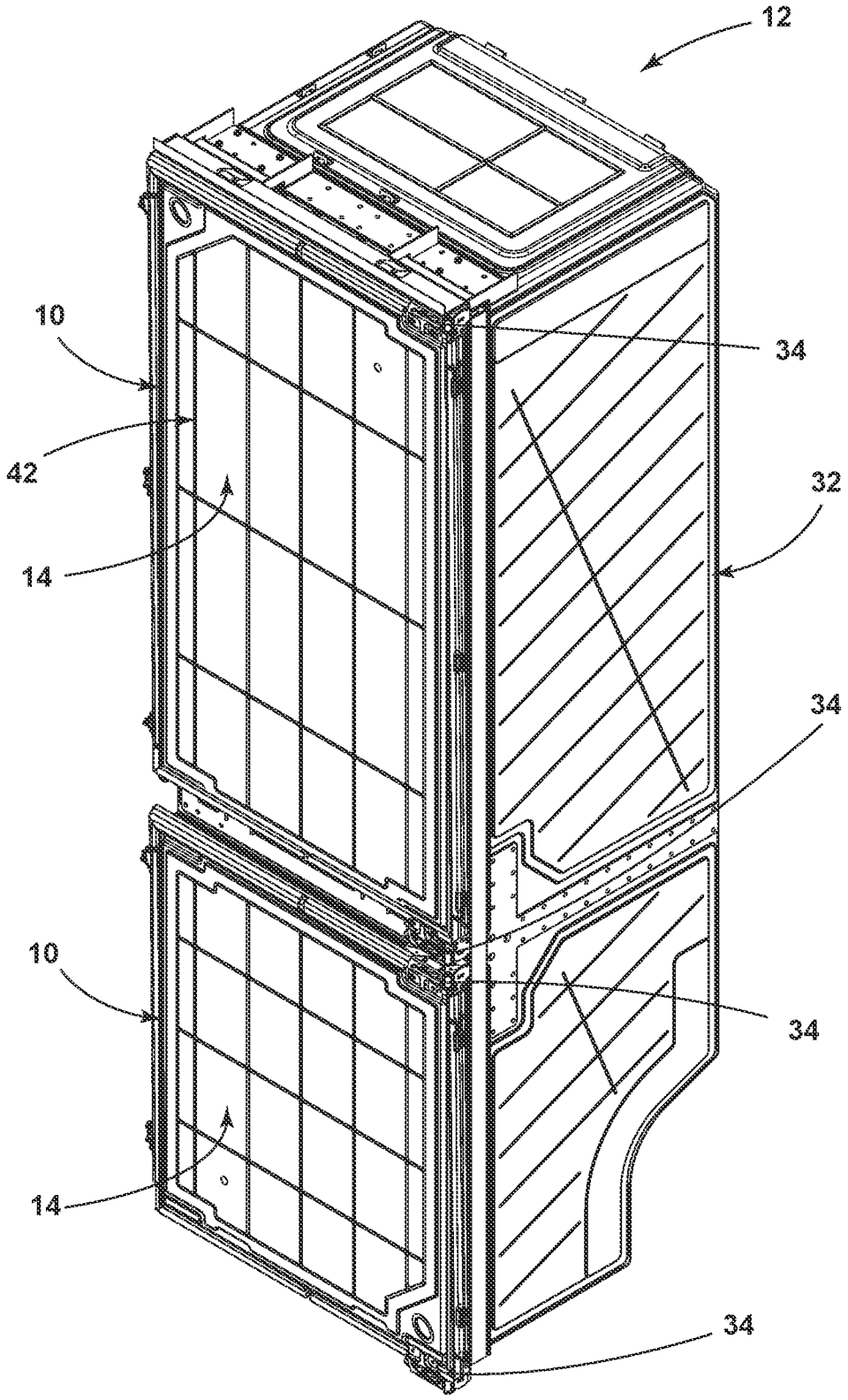
FIG. 2 is a side perspective view of a cooling appliance with an outer layer removed, according to an aspect of the present disclosure.

With reference now to FIGS. 1 and 2, the cooling appliance 12 may be configured as a refrigerator, a freezer, or a combination refrigerator and freezer. The cooling appliance 12 may include one, two, or more vacuum-insulated doors 10. The vacuum-insulated door 10 includes an outer layer 30 that wraps around at least part of the vacuum-insulated door 10. The cooling appliance 12 may include a body 32 that connects to the vacuum-insulated door 10 via a hinge 34. The vacuum-insulated door 10 may include a handle 36 that facilitates moving the vacuum-insulated door 10 between an open position and a closed position. The vacuum-insulated door 10 includes an outer perimeter defined by upper and bottom edges 38 that are spaced vertically by side edges 40. The vacuum-insulated door 10 includes a front surface 42 facing the handle 36 and a rear surface 44 facing the body 32.

Figure 3:
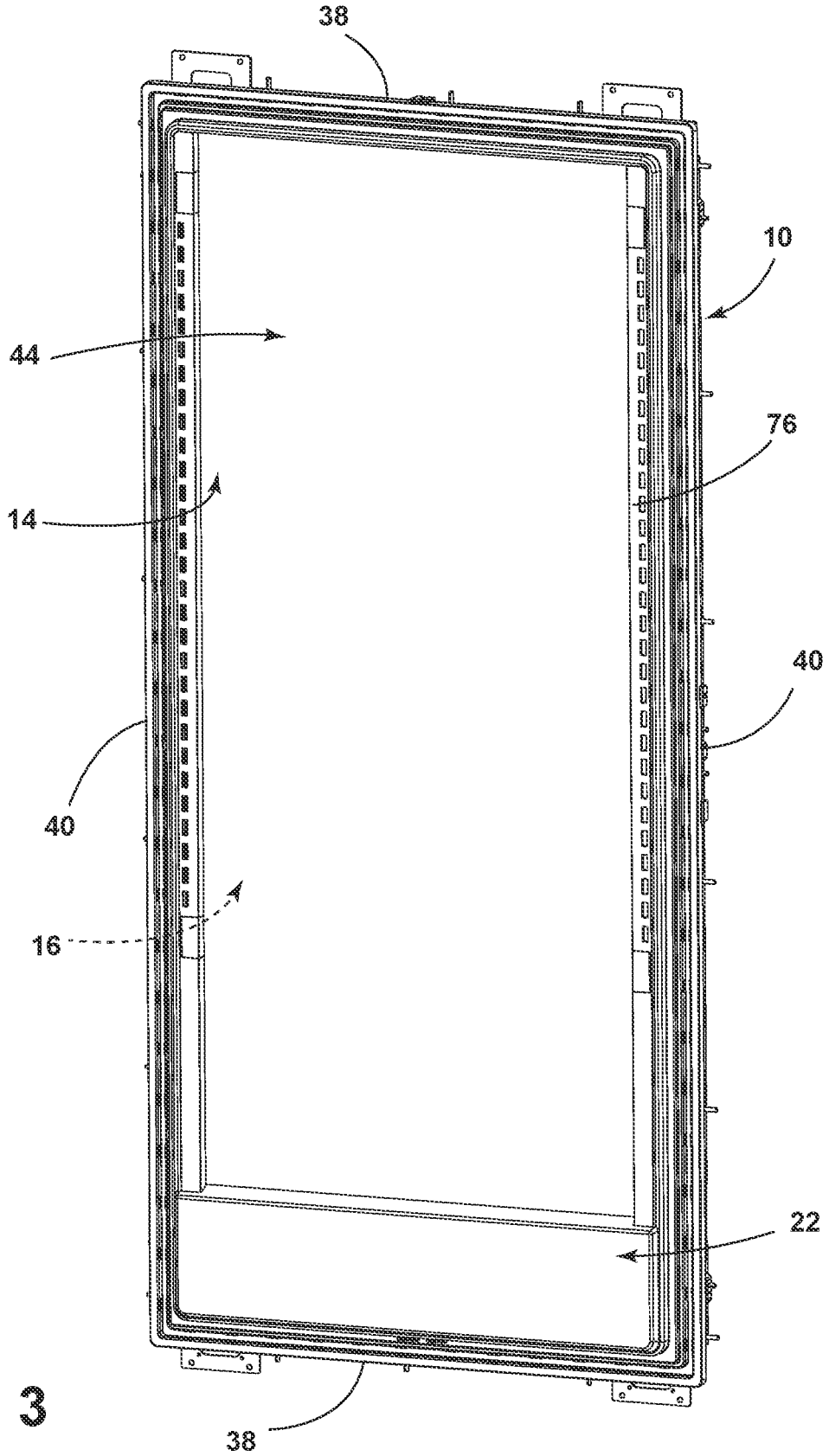
FIG. 3 is a rear perspective view of an interior rear surface of a vacuum-insulated door with a vacuum port cover assembly, according to an aspect of the present disclosure.

With reference now to FIG. 3, the vacuum port 18 may be defined by the rear surface 44. For example, the vacuum port 18 may be located near the bottom edge 38 on the rear surface 44. A sensor 46 may be in fluid communication with the vacuum-insulated cavity 16 through the outer skin 14 for measuring an internal pressure of the vacuum-insulated cavity 16. In some embodiments, the bracket 24 further includes a second pocket 48 for locating the sensor 46. The bracket 24 includes an outer perimeter frame 50 defining an opening and a center support 52 extends across the opening between opposite sides of the outer perimeter frame 50 to divide the opening into the first pocket 26 and the second pocket 48. The vacuum inlet housing 20 and the sensor 46 are horizontally aligned along the bottom edge 38 of the outer skin 14. A vacuum inlet tube 54 may be connected to the vacuum inlet housing 20. The vacuum inlet tube 54 may include a section 56 that extends along the outer skin 14 and the first pocket 26 sized to accommodate the section 56. In this manner, the first pocket 26 may be larger than the second pocket 48. More particularly, the first pocket 26 may extend in a horizontal direction (e.g., in a direction between opposite side edges 40) further than the second pocket 48.

Figure 4:
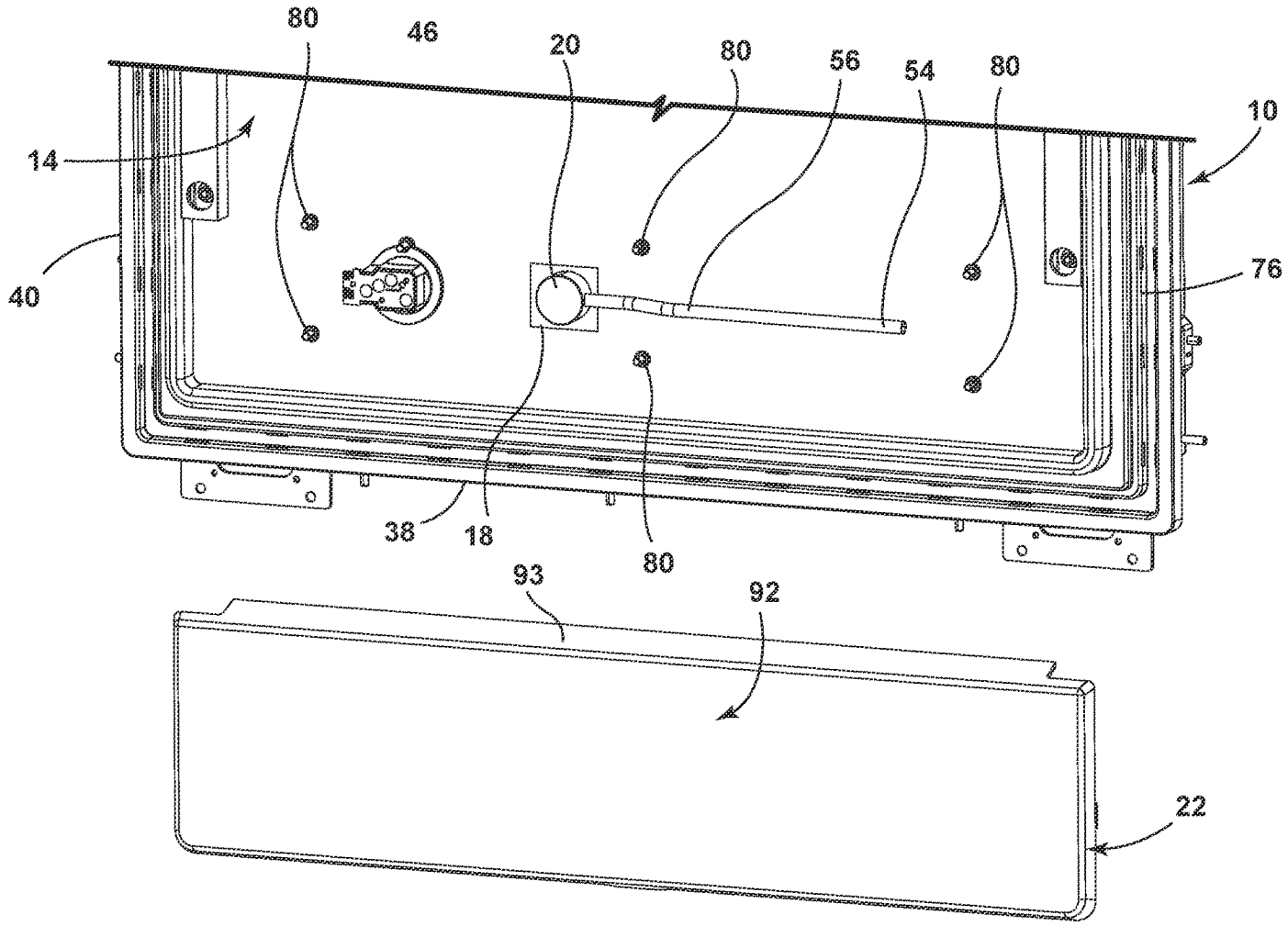
FIG. 4 is a partial enlarged rear perspective view of an interior rear surface of a vacuum-insulated door with a vacuum port cover assembly removed, according to an aspect of the present disclosure.

With reference now to FIG. 4, the outer perimeter frame 50 of the bracket 24 includes a pair on longitudinal edges 58 (e.g., a top and lower longitudinal edge) spaced by a pair of lateral edges 60 (e.g., left and right lateral edges). A pair of wings 62 that are located on diametrically opposite sides of the bracket 24 (e.g., on opposite lateral edges 60). The bracket 24 includes a front bracket face 64 configured to face the outer skin 14 and a rear bracket face 66 configured to face the cover 28. The front bracket face 64 of the bracket 24 and the rear surface 44 of the outer skin 14 may include matching contours. For example, both the front bracket face 64 and the rear surface 44 may be substantially planar. The rear bracket face 66 may include an outer lip 68 that extends around the outer perimeter frame 50 and wings 62. The rear bracket face 66 may further include an inner perimeter lip 70 that extends around the first and second pockets 26, 48. The outer lip 68 and inner lip 70 provide rigidity to the bracket 24 and facilitate connection between the bracket 24, the outer skin 14, and the cover 28.

Figure 5:
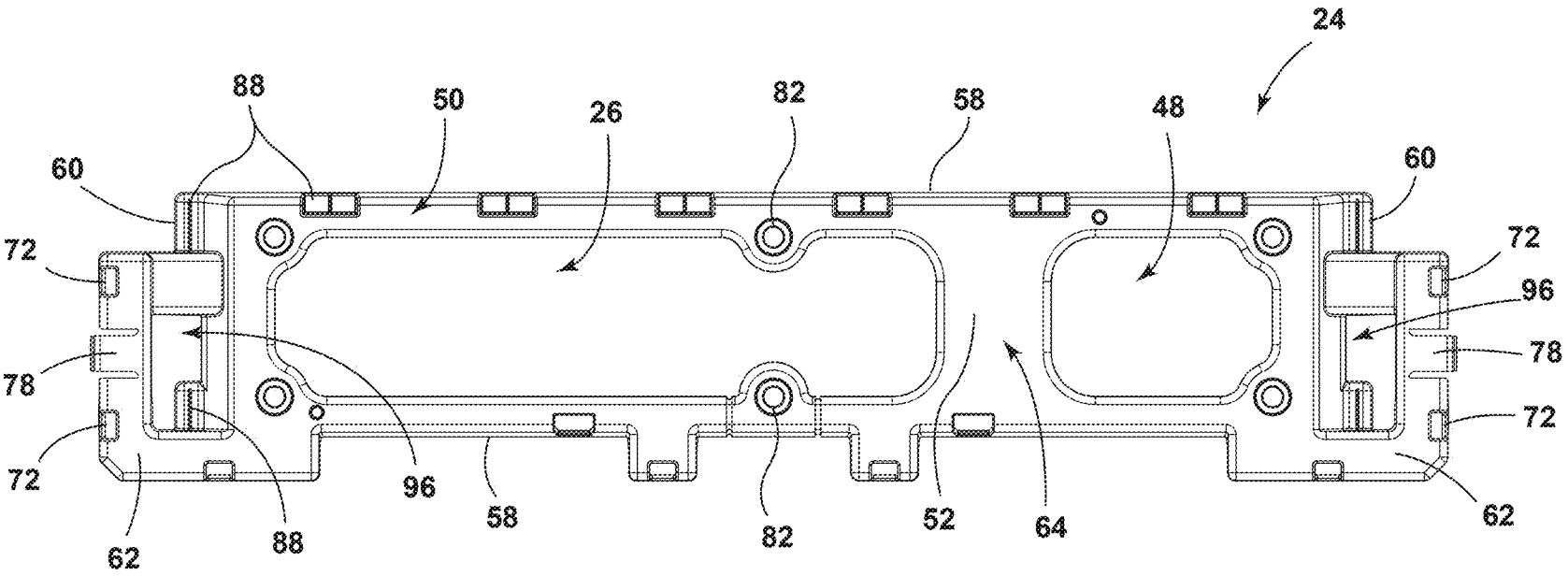
FIG. 5 is a front elevational view of a front bracket face of a bracket, according to an aspect of the present disclosure.
Figure 6:
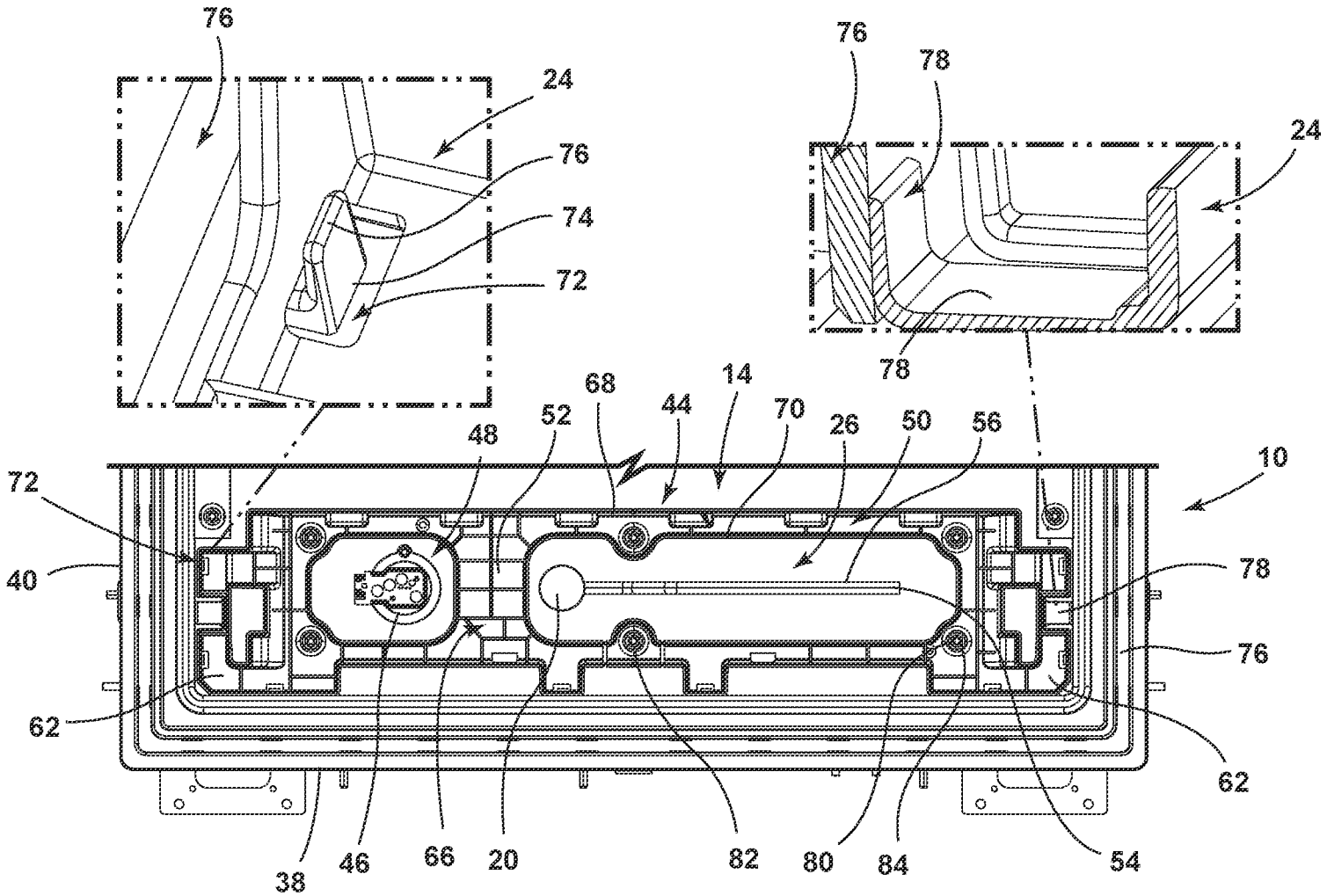
FIG. 6 is a back elevational view of a rear bracket face of a bracket with a front bracket face connected to an outer skin of a vacuum-insulated door, according to an aspect of the present disclosure.

With reference now to FIGS. 5 and 6, the bracket 24 further includes a plurality of slots 72 and the vacuum-insulated door 10 includes a plurality of tabs 74 that are engaged with the slots 72. More particularly, the vacuum-insulated door 10 may include an outer rim 76 that extends at least partially around the outer perimeter (e.g., the whole outer perimeter or the bottom edge 38). The plurality of tabs 74 may align with the lower longitudinal edge 58 of the bracket 24 and the wings 62. The plurality of tabs 74 may include two or more tabs 74, four or more tabs 74, or six or more tabs 74. In the illustrated example, the vacuum-insulated door 10 includes eight tabs 74 along the bottom edge 38 and portion of the side edges 40 proximate the bottom edge 38. The bracket 24 may define an equal number of slots 72 as the number of tabs 74. The tabs 74 may be L-shaped with an interface portion 77 that interlocks with the outer lip 68.

With continued reference to FIGS. 5 and 6, the bracket 24 may further include a plurality of spring fingers 78 that bias the bracket 24 relative to the outer skin 14 and facilitate alignment between the outer skin 14 and the bracket 24. The spring fingers 78 may include groups of two or more spring fingers 78, with each group located on opposite ones of the wings 62. The spring fingers 78 may interlock the outer rim 76 (e.g., a portion of the outer rim 76 associated with the side edges 40). A plurality of studs 80 may extend from the outer skin 14 and the bracket 24 may define a plurality of apertures 82 for receiving the studs 80. In some embodiments, the plurality of studs 80 are welded directly to the outer skin 14. The plurality of studs 80 may each define a threaded body that receives one of a plurality of nuts 84 that lock the bracket 24 to the plurality of studs 80.

Figure 7:
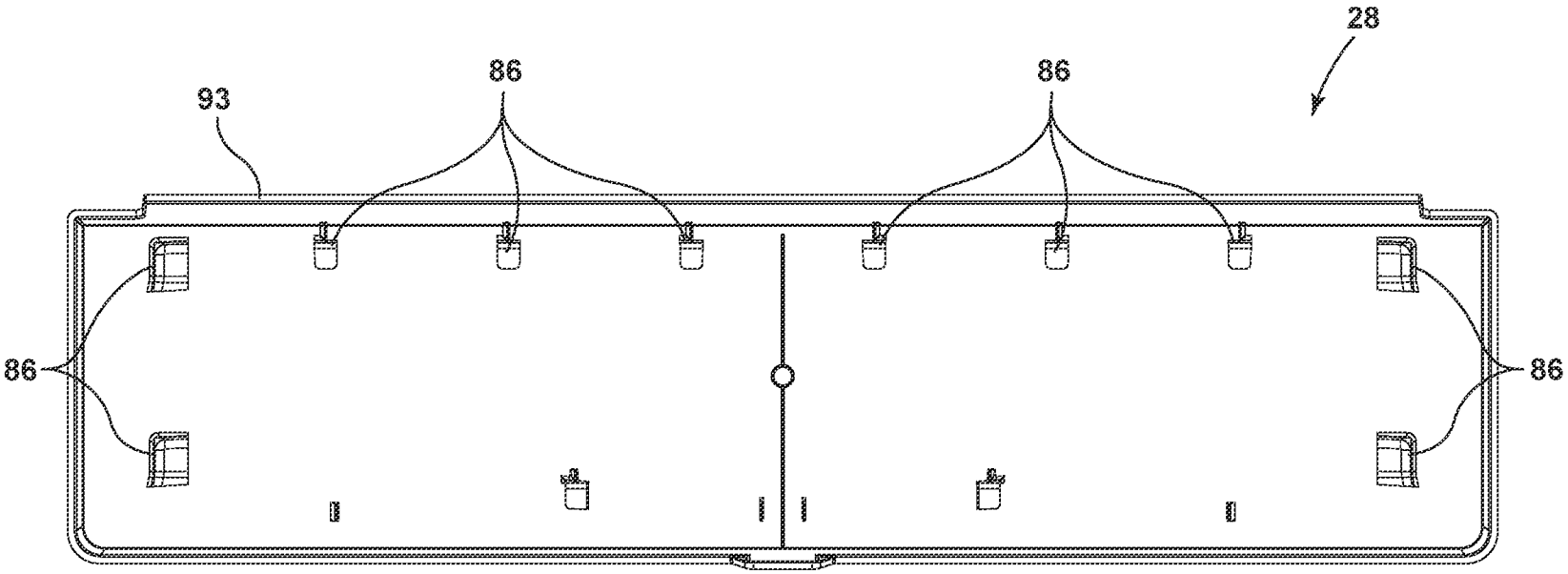
FIG. 7 is a front elevational view of a front cover face of a cover, according to an aspect of the present disclosure.
Figure 8:
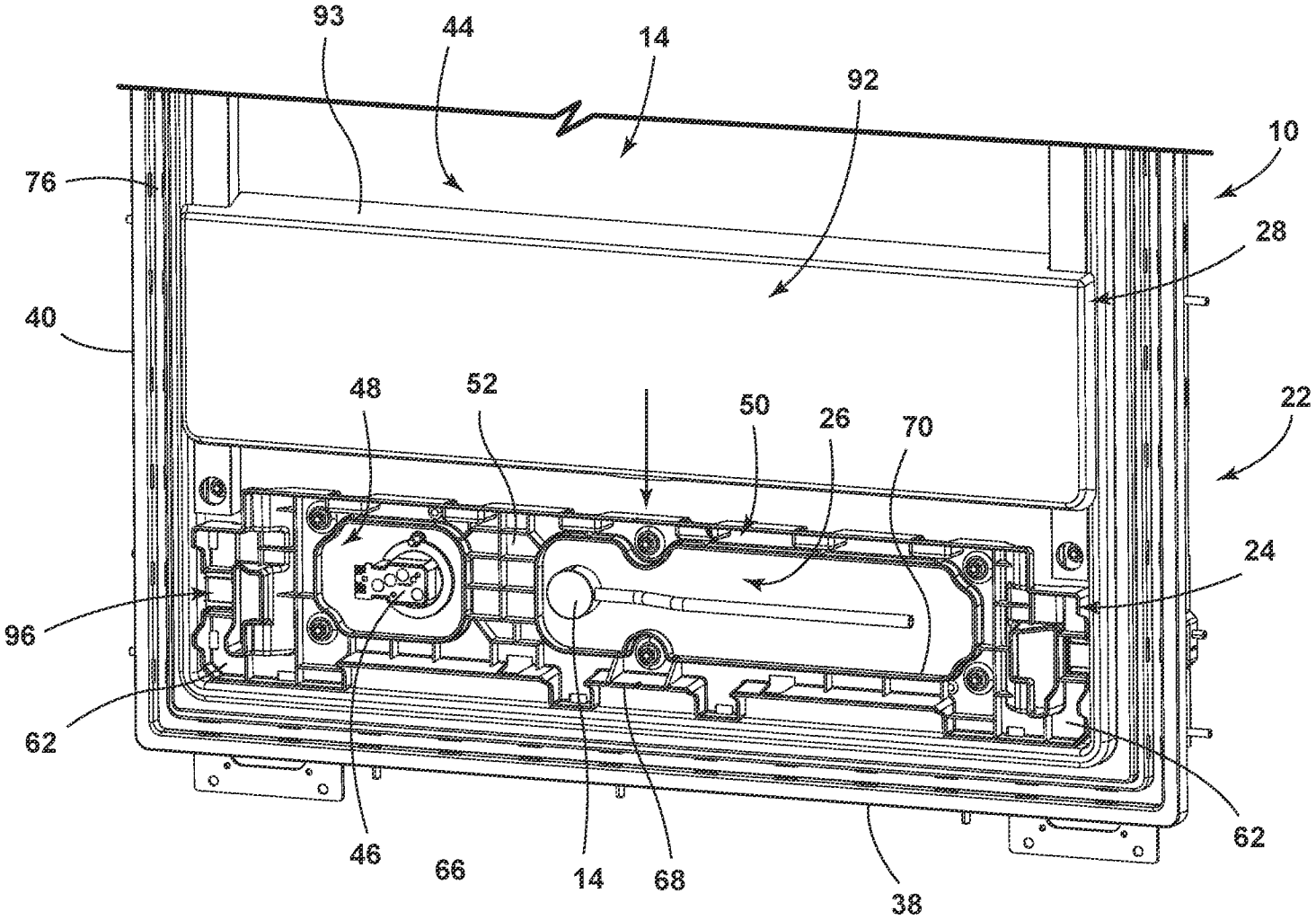
FIG. 8 is a back elevational view of a rear cover face of a cover with a front cover face connected to a bracket, according to an aspect of the present disclosure.
Figure 9:
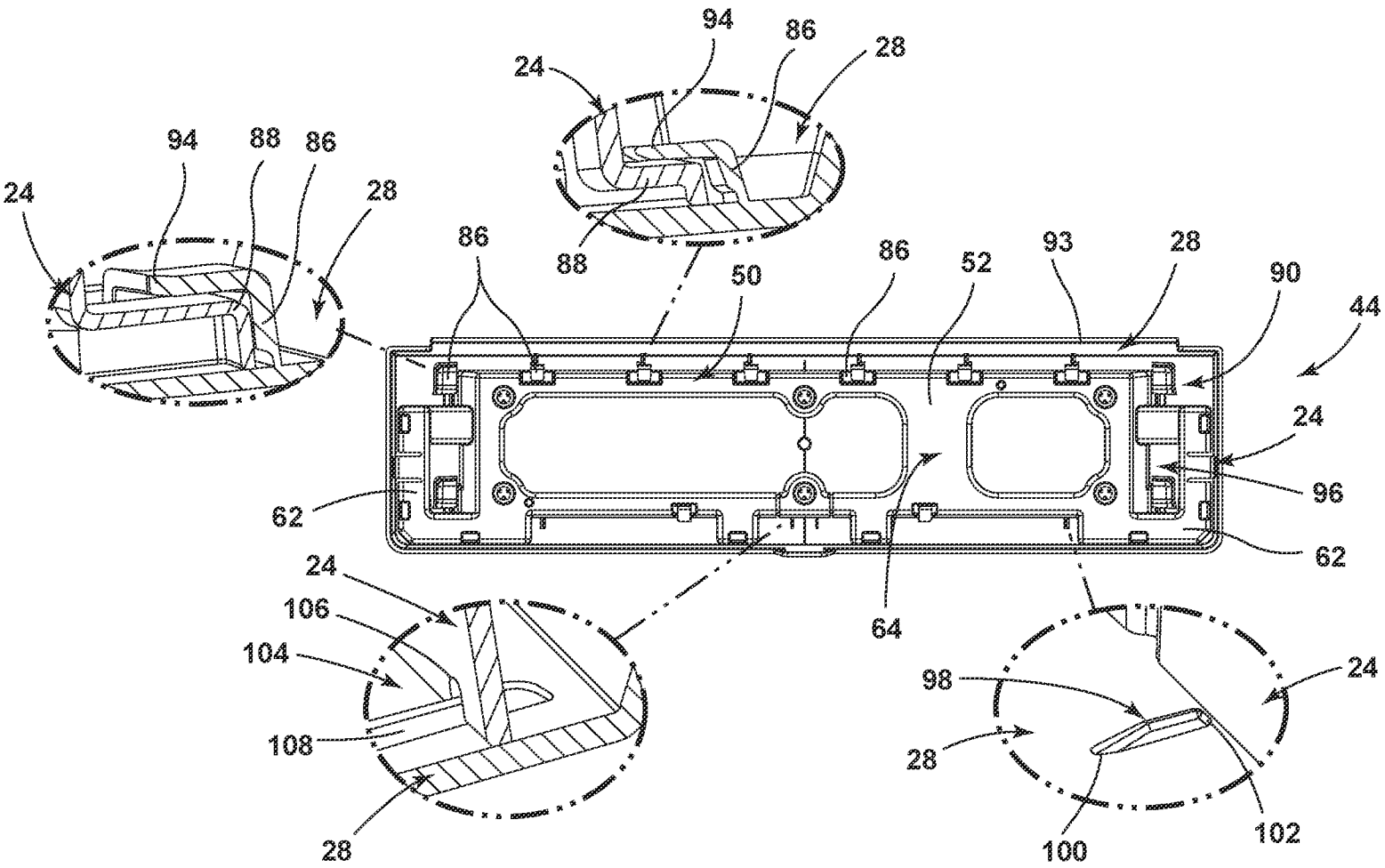
FIG. 9 is a front elevational view of a cover connected to a bracket with various portions of the cover enlarged or enlarged and shown in cross-section, according to an aspect of the disclosure.

With reference now to FIGS. 7-9, the cover 28 may include a plurality of hooks 86 and the bracket 24 may define a plurality of engagement portions 88 that are configured to engage the hooks 86 upon linear movement between the bracket 24 and cover 28 (FIG. 8). More particularly, the cover 28 may include a front cover face 90 that defines the plurality of hooks 86 and a rear cover face 92 that defines a rear, viewable surface to a user. The rear cover face 92 may be substantially planar and lead to a skirt 93 that extends in a direction towards the outer skin 14. In this manner, the cover 28 is connected to the bracket 24 such that the bracket 24 is encased (e.g., non-visible to a user) between the cover 28 and the outer skin 14. Each of the hooks 86 may include an L-shape with a leg portion 94 that overhangs in a direction towards the bracket 24. The engagement portions 88 on the bracket 24 may be defined by recesses along the longitudinal edge 58 that interlock with leg portion 94 by overlapping the leg portion 94 over the engagement portion 88. The leg portions 94 of the plurality of hooks 86 may each face generally the same direction to facilitate linear connection between the bracket 24 and the cover 28. In the illustrated embodiment, a pair of hooks 86 are further aligned with opposite ones of the lateral edges 60 (e.g., the wings 62) and a plurality of hooks 86 are aligned along the top longitudinal edge 58 of the bracket 24. In some embodiments, the wings 62 may each define hook pockets 96 with engagement portions 88 on the perimeter of the hook pockets 96 for connecting to additional hooks 86.

With reference now to FIG. 9, the cover 28 may further include a projection 98 that centers and aligns the cover 28 relative to the bracket 24. The projection 98 may extend between a ramp side 100 and a lock side 102. The ramp side 100 may facilitate connection between the bracket 24 and the cover 28 while the lock side 102 facilitates static connection between the bracket 24 and the cover 28 once connected. The vacuum port cover assembly 22 may further include a central guide 104 that centers and aligns the cover 28 relative to the bracket 24 during connection. More particularly, the central guide 104 may include a first indicia 106 (e.g., a slot or groove) on the bracket 24 and a second indicia 108 (e.g., a slot or groove) on the cover 28 that, when aligned, indicates that the cover 28 and bracket 24 can be connected with linear movement. During assembly, the bracket 24 may be initially connected to the outer skin 14 and, after connection of the bracket, 24, the cover 28 may be connected to the bracket.

The disclosure herein is further summarized in the following paragraphs and is further characterized by combinations of any and all of the various aspects described therein.

According to one aspect of the present disclosure, a vacuum-insulated door for a cooling appliance includes an outer skin defining a vacuum-insulated cavity. A vacuum port is in fluid communication with the vacuum-insulated cavity through the outer skin. A vacuum inlet housing is connected to the vacuum port and extends from the outer skin. A vacuum port cover assembly includes a bracket connected to the outer skin that includes a first pocket for locating the vacuum inlet housing. A cover is connected to the bracket.

According to another aspect, a sensor is in fluid communication with a vacuum-insulated cavity through an outer skin for measuring an internal pressure of the vacuum-insulated cavity.

According to yet another aspect, a bracket further includes a second pocket for locating a sensor.

According to still yet another aspect, a bracket includes an outer perimeter frame defining an opening and a center support extends across the opening between opposite sides of the outer perimeter frame to divide the opening into a first pocket and a second pocket.

According to another aspect, a vacuum inlet housing and a sensor are horizontally aligned along a bottom edge of an outer skin.

According to yet another aspect, a vacuum inlet tube is connected to a vacuum inlet housing, the vacuum inlet tube includes a section that extends along an outer skin and a first pocket is sized to accommodate the section.

According to still yet another aspect, a plurality of tabs are coupled to an outer skin and a bracket defines a plurality of slots engaged with the tabs.

According to another aspect, an outer rim extends along a bottom edge of a vacuum-insulated door, the outer rim defines a plurality of tabs.

According to yet another aspect, a plurality of studs extend from an outer skin and a bracket defines a plurality of apertures for receiving the studs.

According to still yet another aspect, a plurality of studs are welded to an outer skin.

According to another aspect, a plurality of nuts and a plurality of studs each defining a threaded body that receives one of the plurality of nuts and lock a bracket to the plurality of studs.

According to yet another aspect, a bracket defines a plurality of spring fingers that bias the bracket relative to an outer skin and facilitate alignment between the outer skin and the bracket.

According to another aspect, a bracket defines a pair of wings located on diametrically opposite sides of the bracket and a plurality of spring fingers are located on the wings.

According to still yet another aspect, a cover includes a plurality of hooks and a bracket defines a plurality of engagement portions that are configured to engage the hooks upon linear movement between the bracket and the cover.

According to another aspect of the present disclosure, a vacuum-insulated door for a cooling appliance includes an outer skin defining a vacuum-insulated cavity and at least one of a tab or a stud is coupled to the outer skin. A vacuum port is in fluid communication with the vacuum-insulated cavity through the outer skin. A vacuum inlet housing is connected to the vacuum port and extends from the outer skin. A vacuum port cover assembly includes a bracket connected to the outer skin that includes a first pocket for locating the vacuum inlet housing. The bracket further includes at least one of a slot engaged with the tab or an aperture engaged with the stud.

According to another aspect, a cover is connected to a bracket, the cover includes a projection engaged with the bracket to statically fix a position of the cover relative to the bracket.

According to yet another aspect, a central guide centers and aligns a cover relative to a bracket.

According to yet another aspect, a cover includes a plurality of hooks and a bracket defines a plurality of engagement portions that are configured to engage the hooks upon linear movement between the bracket and the cover.

According to yet another aspect of the present disclosure, a vacuum-insulated door for a cooling appliance includes an outer skin defining a vacuum-insulated cavity. At least one stud is coupled to the outer skin. A vacuum port is in fluid communication with the vacuum-insulated cavity through the outer skin. A vacuum inlet housing is connected to the vacuum port and extends from the outer skin. A vacuum port cover assembly includes a bracket having at least one aperture receiving the at least one stud. The bracket further includes a first pocket for locating the vacuum inlet housing. A cover is connected to the bracket such that the bracket is encased between the cover and the outer skin.

According to another aspect, a bracket defines a pair of wings located on diametrically opposite sides of the bracket and a plurality of spring fingers are located on the wings. The plurality of spring fingers bias the bracket relative to an outer skin and facilitate alignment between the outer skin and the bracket.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, and the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A vacuum-insulated door for a cooling appliance comprising:

an outer skin defining a vacuum-insulated cavity;

a vacuum port in fluid communication with the vacuum-insulated cavity through the outer skin;

a vacuum inlet housing connected to the vacuum port and extending from the outer skin; and a vacuum port cover assembly including:

a bracket connected to the outer skin that includes a first pocket for locating the vacuum inlet housing, wherein the bracket defines a plurality of spring fingers that bias the bracket relative to the outer skin and facilitate alignment between the outer skin and the bracket; and a cover connected to the bracket.

2. The vacuum-insulated door of claim 1, further including a sensor in fluid communication with the vacuum-insulated cavity through the outer skin for measuring an internal pressure of the vacuum-insulated cavity.

3. The vacuum-insulated door of claim 2, wherein the bracket further includes a second pocket for locating the sensor.

4. The vacuum-insulated door of claim 3, wherein the bracket includes an outer perimeter frame defining an opening and a center support extends across the opening between opposite sides of the outer perimeter frame to divide the opening into the first pocket and the second pocket.

5. The vacuum-insulated door of claim 4, wherein the vacuum inlet housing and the sensor are horizontally aligned along a bottom edge of the outer skin.

6. The vacuum-insulated door of claim 1, further including a vacuum inlet tube connected to the vacuum inlet housing, the vacuum inlet tube includes a section that extends along the outer skin and the first pocket sized to accommodate the section.

7. The vacuum-insulated door of claim 1, further including a plurality of tabs coupled to the outer skin, and wherein the bracket defines a plurality of slots engaged with the tabs.

8. The vacuum-insulated door of claim 7, further including an outer rim extending along a bottom edge of the vacuum-insulated door, the outer rim defining the plurality of tabs.

9. The vacuum-insulated door of claim 1, further including a plurality of studs extending from the outer skin, and wherein the bracket defines a plurality of apertures for receiving the studs.

10. The vacuum-insulated door of claim 9, wherein the plurality of studs are welded to the outer skin.

11. The vacuum-insulated door of claim 10, further including a plurality of nuts, and wherein the plurality of studs each define a threaded body that receives one of the plurality of nuts that lock the bracket to the plurality of studs.

12. The vacuum-insulated door of claim 1, wherein the bracket defines a pair of wings located on diametrically opposite sides of the bracket and the plurality of spring fingers are located on the wings.

13. The vacuum-insulated door of claim 1, wherein the cover includes a plurality of hooks and the bracket defines a plurality of engagement portions that are configured to engage the hooks upon linear movement between the bracket and the cover.

14. A vacuum-insulated door for a cooling appliance comprising:

an outer skin defining a vacuum-insulated cavity;

at least one of a tab or a stud coupled to the outer skin;

a vacuum port in fluid communication with the vacuum-insulated cavity through the outer skin;

a vacuum inlet housing connected to the vacuum port and extending from the outer skin;

a sensor in fluid communication with the vacuum-insulated cavity through the outer skin for measuring an internal pressure of the vacuum-insulated cavity; and a vacuum port cover assembly including:

a bracket connected to the outer skin that includes a first pocket for locating the vacuum inlet housing and a second pocket that is smaller than the first pocket for accommodating the sensor, the bracket further including at least one of a slot engaged with the tab or an aperture engaged with the stud.

15. The vacuum-insulated door of claim 14, further including a cover connected to the bracket, the cover including a projection engaged with the bracket to statically fix the position of the cover relative to the bracket.

16. The vacuum-insulated door of claim 15, further including a central guide that centers and aligns the cover relative to the bracket.

17. The vacuum-insulated door of claim 15, wherein the cover includes a plurality of hooks and the bracket defines a plurality of engagement portions that are configured to engage the hooks upon linear movement between the bracket and the cover.

18. A vacuum-insulated door for a cooling appliance comprising:

an outer skin defining a vacuum-insulated cavity;

at least one stud coupled to the outer skin;

a vacuum port in fluid communication with the vacuum-insulated cavity through the outer skin;

a vacuum inlet housing connected to the vacuum port and extending from the outer skin; and a vacuum port cover assembly including:

a bracket including at least one aperture receiving the at least one stud, the bracket further including a first pocket for locating the vacuum inlet housing; and a cover connected to the bracket such that the bracket is encased between the cover and the outer skin.

19. The vacuum-insulated door of claim 18, wherein the bracket defines a pair of wings located on diametrically opposite sides of the bracket and a plurality of spring fingers are located on the wings, wherein the plurality of spring fingers bias the bracket relative to the outer skin and facilitate alignment between the outer skin and the bracket.

* * * * *